US006925663B1

(12) United States Patent
Peterson, Jr. et al.

(10) Patent No.: US 6,925,663 B1
(45) Date of Patent: Aug. 9, 2005

(54) CRIB WITH HIDDEN HARDWARE

(76) Inventors: William E. Peterson, Jr., 272 Sue Dr., Hummelstown, PA (US) 17036; Manuel Cardona, 237 Evergreen St., Harrisburg, PA (US) 17104; Andrew De Palma, 3005 Walnut St., Harrisburg, PA (US) 17103

( * ) Notice: Subject to any disclaimer, the term of this patent is extended or adjusted under 35 U.S.C. 154(b) by 30 days.

(21) Appl. No.: 10/805,143

(22) Filed: Mar. 19, 2004

(51) Int. Cl.[7] ..... A47D 7/02
(52) U.S. Cl. ..... 5/100; 5/93.1
(58) Field of Search ..... 5/100, 93, 428, 5/93.1

(56) References Cited

U.S. PATENT DOCUMENTS

| | | | | |
|---|---|---|---|---|
| 1,862,383 | A * | 6/1932 | Mayette | 5/100 |
| 3,193,849 | A | 7/1965 | Landry | |
| 3,649,973 | A | 3/1972 | Benoit et al. | |
| 3,900,907 | A | 8/1975 | Mulder | |
| 3,934,282 | A | 1/1976 | Bryant | |
| 4,706,312 | A | 11/1987 | Shamie | |
| 4,811,436 | A * | 3/1989 | Schwartz | 5/93.1 |
| 4,850,066 | A | 7/1989 | Benoit | |
| 4,924,539 | A * | 5/1990 | Benoit | 5/100 |
| 5,134,734 | A | 8/1992 | Bozino | |
| 5,165,124 | A | 11/1992 | Li | |
| 5,201,085 | A | 4/1993 | Shamie | |
| 5,327,594 | A | 7/1994 | Sun | |
| 5,617,593 | A | 4/1997 | Pham | |
| 6,088,851 | A | 7/2000 | Draheim | |
| 6,571,409 | B2 | 6/2003 | Guillot | |
| 6,611,976 | B2 | 9/2003 | Guillot | |
| 2002/0157182 | A1 * | 10/2002 | Guillot | 5/100 |
| 2003/0005520 | A1 | 1/2003 | Hofer et al. | |

* cited by examiner

*Primary Examiner*—Heather Shackelford
*Assistant Examiner*—Lisa M. Saldano
(74) *Attorney, Agent, or Firm*—Kollas and Kennedy; James W. Kollas, Esquire

(57) ABSTRACT

A crib device is provided for raising and lowering the dropside of a slatted crib. The dropsides are fitted with side rails attached to the outer slats. The side rails are channeled to receive a rod. The side rails fit within corner legs which are slotted to receive the side rails. The corner legs are also channeled to receive a rod. When the side rails are fitted within the corner legs, a slide rod is positioned through the respective channels. A latching mechanism is used to lock the dropside in place via a latching rod and latch rod recesses, which are located on the corner legs. When the latching mechanism is activated the dropside moves vertically along the slide rod with reduced risk of injury to both the user of the crib and the occupant of the crib as the outer slats block unwanted access to the slotted region of the corner legs.

10 Claims, 6 Drawing Sheets

CRIB WITH HIDDEN HARDWARE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

1. Field of the Invention

This invention is directed toward the field of crib dropside assemblies, more particularly to crib dropside assemblies with hidden hardware in corner posts.

2. Discussion of Prior Art

Crib dropside assemblies are employed for allowing at least one of the sides of a crib to be raised or lowered. Access to an infant is thereby facilitated. These cribs are well known in the prior art, and typically employ sides with slats mounted between upper and lower rails. Usually, the long sides of the crib are dropsides, while the short sides of the cribs remain fixed.

Perhaps the most common crib hardware for a dropside assembly is one with a vertical rod mounted parallel to each crib end post, extending through grommets in the top and bottom rails of the side. A latching bar is provided along the bottom rail, which projects into and engages stationary catch elements on the surface of the end posts. The latching bar can be spring biased with the catch elements configured so that simultaneous turning of the bar and a slight lifting of the side is required to release the latch and permit lowering of the side. Alternatively, the latching bar and catch elements can be actuated via a pressure plate connected to the latch elements by rods, such that the double action of pushing the plate in one direction and then a second direction will release the catch elements, and thereby the side, without the need for the slight lifting aforesaid.

The presence of exposed hardware is problematic in crib structures. Aside from being aesthetically unpleasant, children may find exposed hardware a curiosity demanding investigation via touching or tasting. In either case, children can suffer physical injury by interacting with exposed hardware. Such injuries may include laceration, blunt trauma, or disfigurement. Exposed hardware cavities create the risk of pinching fingers of both a child and an adult who, presumably, will be operating the vertical movement of the dropside. Moreover, such cavities or gaps can catch clothing or bedding, damaging both to the annoyance of the operator of the dropside assembly.

There are many crib designs that attempt to minimize the exposure of babies to the potential attractions and dangers of crib hardware. For example, the gap between the ends of a releasable crib side and ends of the crib has been reduced by the simple expedient of providing posts at the ends of the side, with mounting hardware coupling the posts to the adjacent crib ends. U.S. Pat. No. 4,811,436, to Schwartz, illustrates a design with slotted end posts providing a guide path for spring biased locking pins in the side posts. U.S. Pat. No. 5,617,593, to Pham, shows a pin guiding track embedded in the end posts which engage a spring loaded pin mounted in the side post. U.S. Pat. Nos. 6,571,409 and 6,611,976 to Guillot disclose top and bottom side post mounted hardware that employs a complex housing/latching mechanism to accomplish its goals. Until the present invention, there has been no uncomplicated design that completely concealed the crib hardware whether the side was in its raised or lowered position.

BRIEF SUMMARY OF THE INVENTION

In accordance with the present invention, a crib with hidden hardware to allow vertical movement of a side of the crib is presented. That is, a crib device is provided for raising and lowering the dropside of a slatted crib. The dropsides are fitted with side rails attached to the outer slats. The side rails are channeled to receive a rod. The side rails fit within corner legs which are slotted to receive the side rails. The corner legs are also channeled to receive a rod. When the side rails are fitted within the corner legs, a slide rod is positioned through the respective channels. A latching mechanism is used to lock the dropside in place via a latching rod and latch rod recesses, which are located on the corner legs. When the latching mechanism is activated the dropside moves vertically along the slide rod with reduced risk of injury to both the user of the crib and the occupant of the crib as the outer slats block unwanted access to the slotted region of the corner legs.

Objects and Advantages

Accordingly, the objects and advantages of the invention are:

A) to provide a dropside crib assembly with hidden hardware.

B) to provide a dropside crib assembly with hidden hardware that greatly reduces the chance of injury to a child.

C) to provide a dropside crib assembly with hidden hardware that remains hidden whether the side is raised or lowered.

D) to provide a dropside crib assembly with hidden hardware located in the corner legs of a child's crib.

E) to provide a dropside crib assembly with reduced risk of injury to both the user and occupant of the crib by limiting access to the hardware and slotted regions which enable vertical movement of the dropside.

Further objects and advantages are to provide a dropside crib assembly that greatly reduces cavities or gaps along the side rail that can catch clothing or bedding, damaging both to the annoyance of the operator of the dropside assembly. Still further objects and advantages will become apparent from consideration of the ensuing description and drawings.

REFERENCE NUMERALS IN DRAWINGS

10 Front Corner Leg (First)

11 Front Corner Leg (Second)

12 Front Corner Leg Slot (First)

13 Front Corner Leg Slot (Second)
14 Front Corner Leg Slide Rod Channel (First)
15 Front Corner Leg Slide Rod Channel (Second)
16 Latch Rod Catch Recess (First)
17 Latch Rod Catch Recess (Second)
18 Vertical Slide Rod (First)
19 Vertical Slide Rod (Second)
20 Vertical Slide Rod Threads
22 Side Rail (First)
23 Side Rail (Second)
24 Side Rail Slide Rod Channel (First)
25 Side Rail Slide Rod Channel (Second)
26 Side Rail Slat (First)
27 Side Rail Slat (Second)
28 Latch Rod Support Recess (First)
29 Latch Rod Support Recess (Second)
30 Latch Rod Channel (First)
31 Latch Rod Channel (Second)
32 Latch Rod (First)
33 Latch Rod (Second)
34 Vertical Slat
36 Top Horizontal Bar
38 Bottom Horizontal Bar
40 Dropside
42 Footplate

DETAILED DESCRIPTION OF INVENTION

Figure 1:
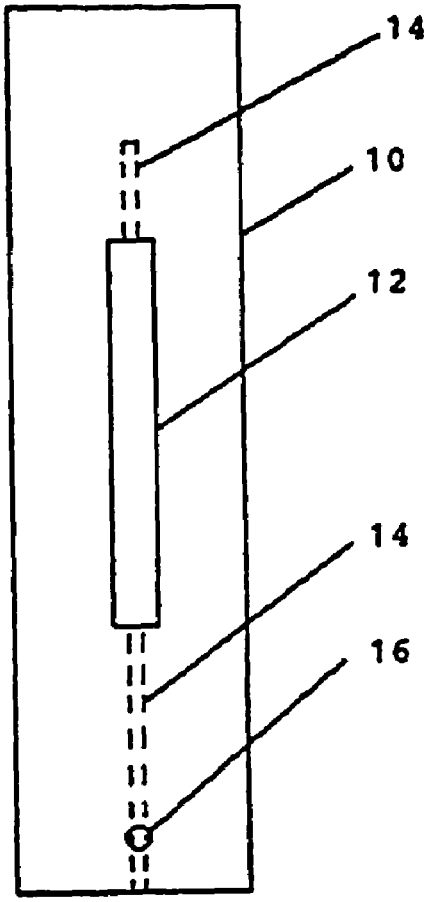
FIG. 1 is a Front View of the front corner leg.
Figure 1A:
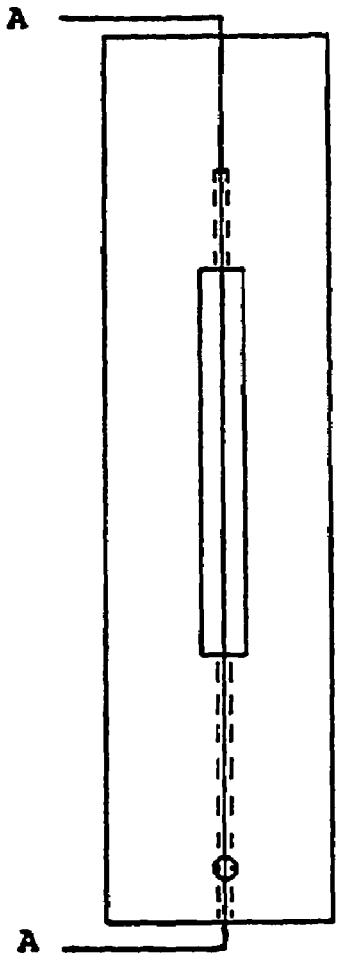
FIG. 1A is a Front View of the front corner leg with plane A—A showing.
Figure 3:
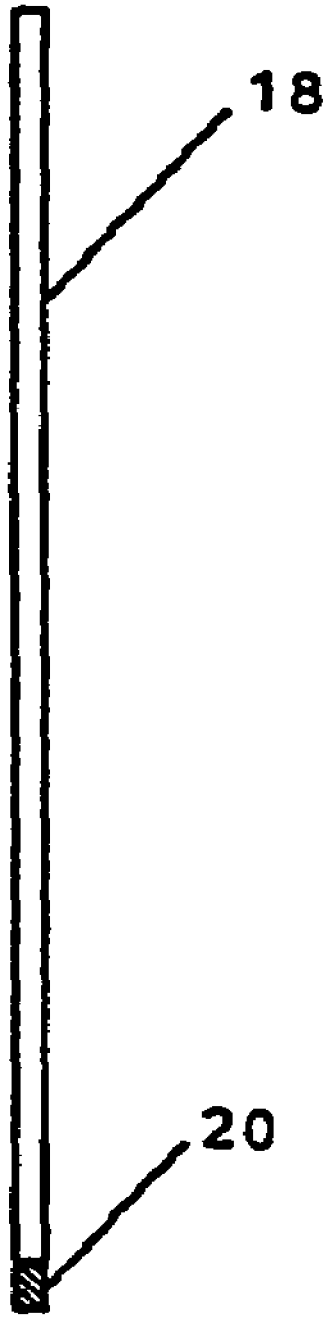
FIG. 3 is a Front View of the Vertical Slide Rod.
Figure 4:
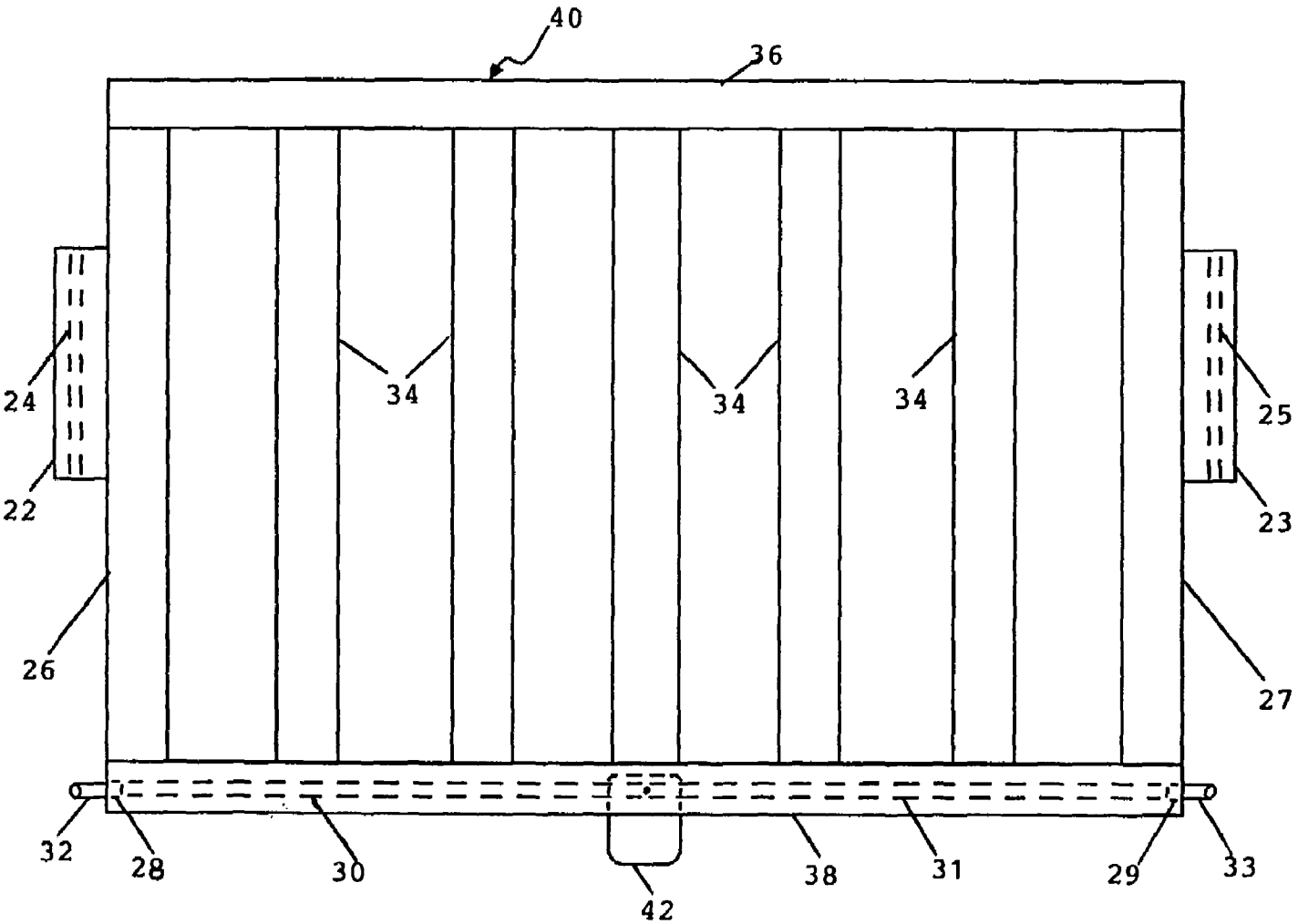
FIG. 4 is a Front View of the Dropside.

As stated above, FIG. 1 shows a Front View of the Front Corner Leg 10. Front Corner Leg Slot 12 is a slotted region which accepts Side Rail 22, which is shown in FIG. 4. Slide Rail 22 rides along Vertical Slide Rod 18. Vertical Slide Rod 18 fits within Front Corner Leg Slide Rod Channel 14, which is shown in both FIGS. 1 and 2. Vertical Slide Rod 18, shown in FIG. 3, is secured within Front Corner Leg 10 via a wheel stud interference fit. Said wheel stud is attached to said Vertical Slide Rod 18 by Vertical Slide Rod Threads 20. When wheel is attached to said wheel stud and the entire crib is assembled, Vertical Slide Rod 18 remains fixed within Front Corner Leg Slide Rod Channel 14. When completely assembled, Side Rail 22 rests within Front Corner Leg Slot 12, and Vertical Slide Rod 18 rests within Front Corner Leg Slide Rod Channel 14 and Side Rail Slide Rod Channel 24, which are aligned along Vertical Slide Rod 18.

Figure 2:
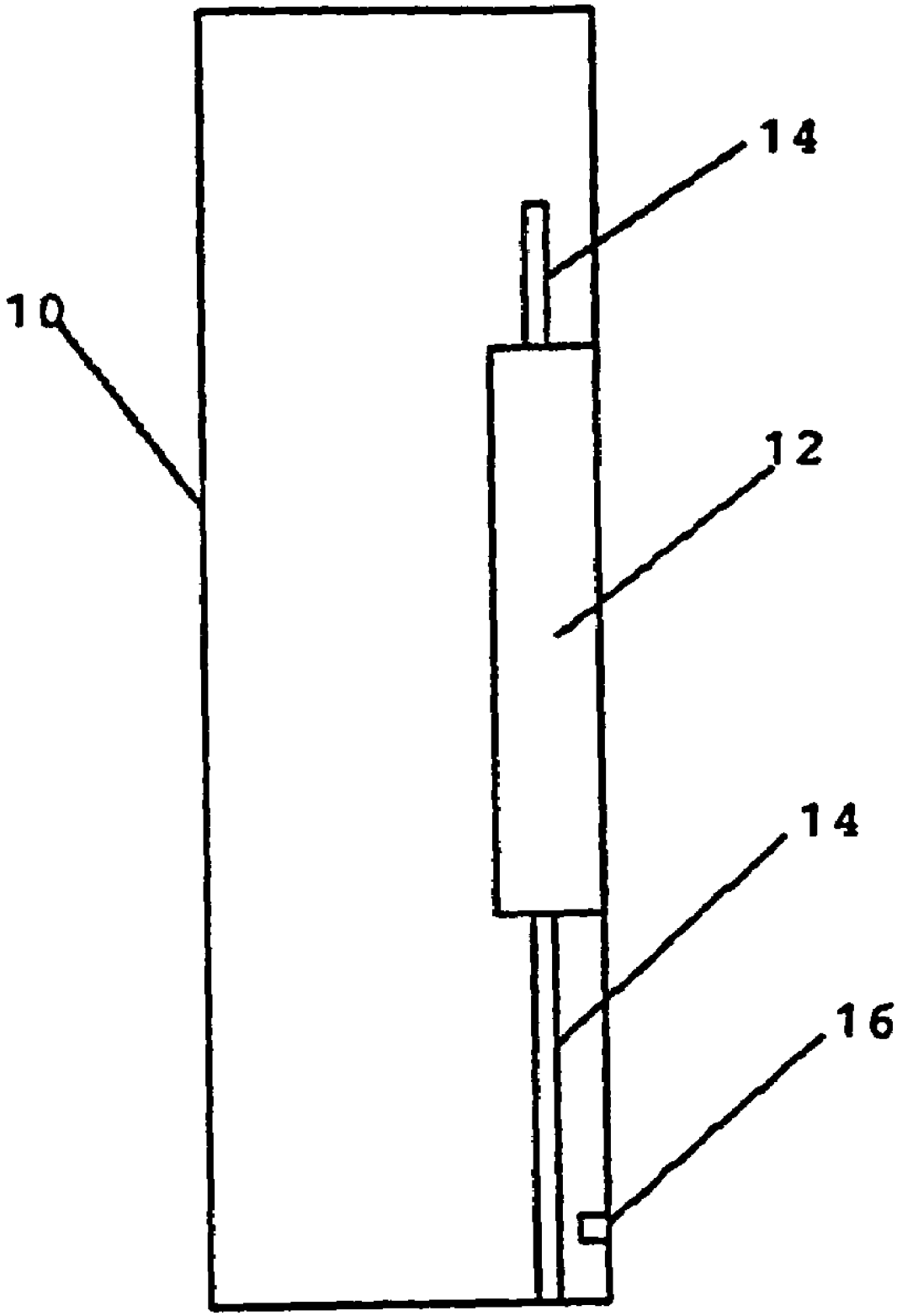
FIG. 2 is a Side View of the front corner leg along plane A—A.

Latch Rod Catch Recess 16, as shown in FIGS. 1 and 2, accepts Latch Rod 32 when the Dropside 40 is in its locked upright position. More specifically, Latch Rod 32, which rests within Latch Rod Channel 30, passes through Latch Rod Support Recess 28 and into Latch Rod Catch Recess 16 when Dropside 40 is in its locked upright position. In the preferred embodiment, a threaded insert is placed within Latch Rod Catch Recess 16, and a bushing is placed within Latch Rod Support Recess 28.

Preferably, Latch Rod 32 is spring biased with Latch Rod Catch Recess 16 configured so that simultaneous turning of Latch Rod 32, via pressure on Footplate 42, and a slight lifting of Dropside 40 is required to release Latch Rod 32 from Latch Rod Catch Recess 16 and permit lowering of Dropside 40 as Side Rail 22 moves vertically along Vertical Slide Rod 18. Stated another way, while the user exerts slight lifting pressure on Dropside 40, the user will simultaneously press Footplate 42 so that Latch Rod 32 is actuated and released from Latch Rod Catch Recess 16. Thereby, Dropside 40 lowers.

Figure 5:
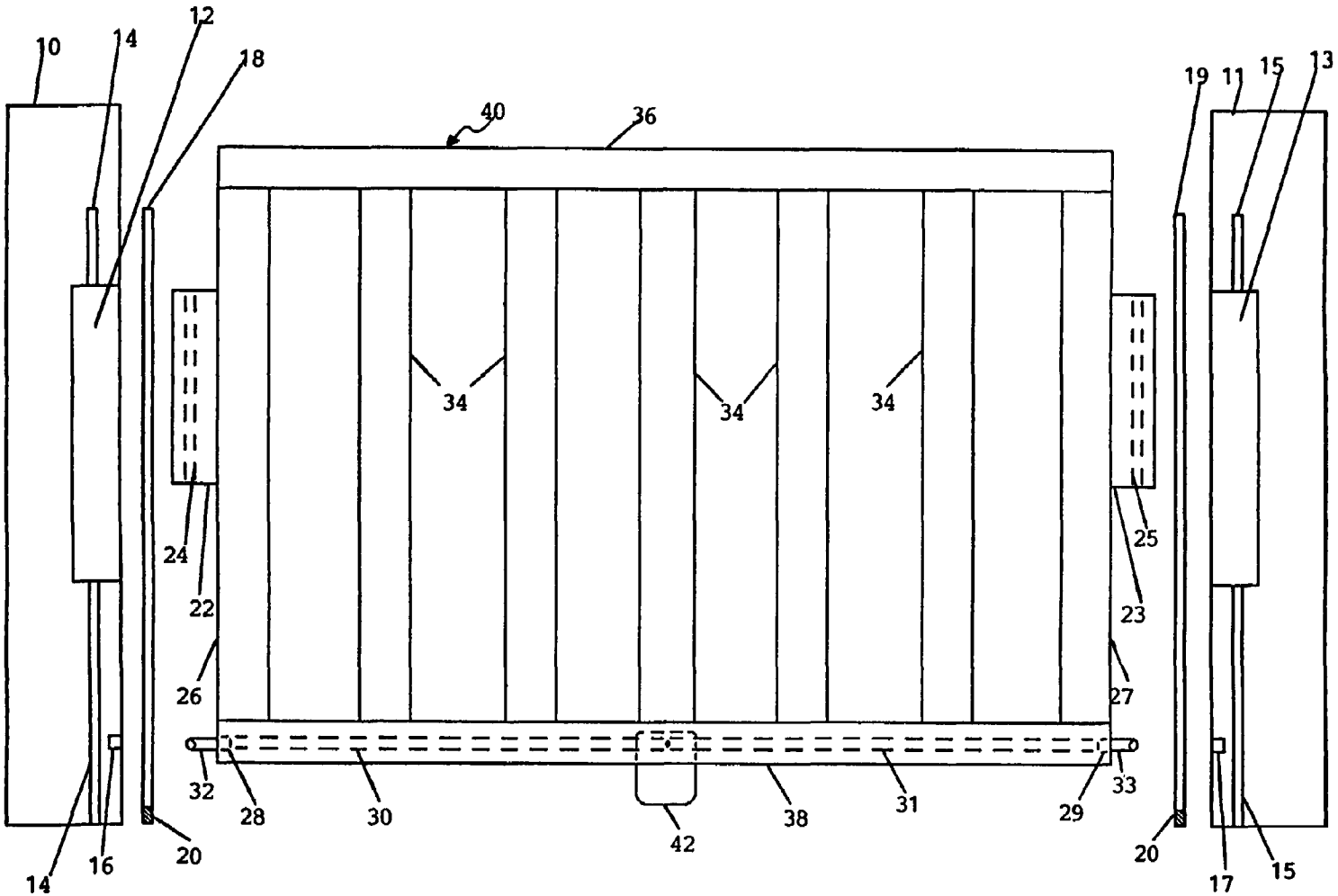
FIG. 5 is a Side View of the Dropside Assembly.

In the locked upright position, the top of Side Rail 22 is positioned near the top of Front Corner Leg Slot 12. These features need not touch, but can be made to do so if desired. Side Rail Slat 26, which is attached to Side Rail 22, blocks access to Front Corner Leg Slot 12, preventing a child's fingers from entering Front Corner Leg Slot 12. See FIG. 5.

When Dropside 40 is in its fully lowered position, the bottom of Side Rail 22 rests along the bottom of Front Corner Leg Slot 12. Once again, Side Rail Slat 26 blocks access to Front Corner Leg Slot 12, preventing a child's fingers from entering Front Corner Leg Slot 12.

As shown in FIG. 4, and as is common in cribs in the prior art, Slats 34 run at intervals between the Top Horizontal Bar 36 and Bottom Horizontal Bar 38. Moreover, FIG. 4 shows the preferred location of Footplate 42 along Bottom Horizontal Bar 38.

The description of features and the illustrations shown in FIGS. 1 through 3 have been directed to the left side of the crib dropside assembly. Corresponding features are provided at the right side of the crib dropside assembly. As such, the features have been labeled with First and Second as put forth in the Reference Numerals and Drawings section, supra.

Figure 4A:
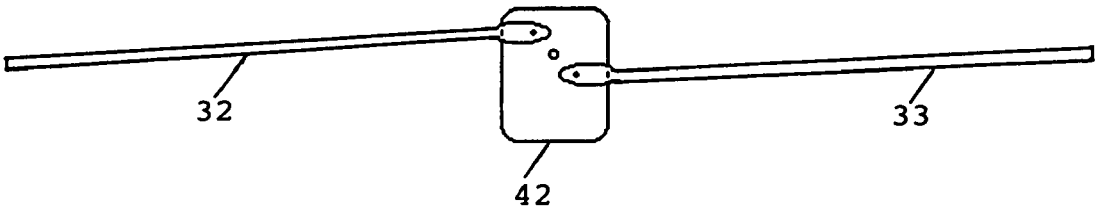
FIG. 4A is a Front View of the Footplate and Latch Rods.
Figure 4B:
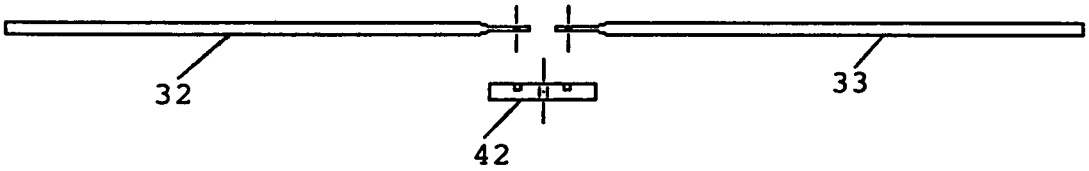
FIG. 4B is a Side View of the Footplate and Latch Rods.

As shown in FIG. 4, Dropside 40 comprises Top Horizontal Bar 36 and Bottom Horizontal Bar 38, multiple Slats 34 attached to said bars and spaced at intervals, Side Rail Slats 26 and 27, Side Rails 22 and 23, Side Rail Slide Rod Channels 24 and 25, and a latching means mounted to or preferably within Bottom Horizontal Bar 38. Said latching means preferably comprises Latch Rod Channels 30 and 31, Latch Rods 32 and 33, Latch Rod Support Recesses 28 and 29, Latch Rod Catch Recesses 16 and 17, and Footplate 42, which is connected to Latch Rods 32 and 33. Footplate 42 and Latch Rods 32 and 33 are connected as shown in FIGS. 4A and 4B. It is understood that the intervals between the slats should not exceed the maximum safe distance needed to prevent injury to a child.

The vertical movement of the Dropside 40 is constrained by the relative sizes of Side Rails 22 and 23 and Front Corner Leg Slots 12 and 13. As such, altering the relative sizes of the vertical faces of Side Rails 22 and 23 and Front Corner Leg Slots 12 and 13 changes the length or range of the dropside vertical movement. This may be better understood upon viewing the dropside assembly in FIG. 5.

In the preferred embodiment, spacers are placed on the ends of the Top Horizontal Bar 36 and Bottom Horizontal Bar 38 to aid smooth vertical movement of the Dropside 40. Preferably, said spacers are made of nylon.

Alternative Embodiments

While the above description contains many specificities, these should not be construed as limitations on the scope of the invention, but rather as an exemplification of one preferred embodiment thereof. Many variations are possible and some are as follows.

Both long sides of the crib can be equipped with the dropside assembly. That is, both the front side and the rear side of the crib can be made to have a dropside assembly. Such a crib would allow more access by a user to a baby in the crib, but would be more expensive to construct and purchase.

A threaded insert may be added to the lower portion of Front Corner Leg Slide Rod Channel 14. Although this adds some complexity, it also adds more stability to fixing Vertical Slide Rod 18 within Front Corner Leg Slide Rod Channel 14.

Top Horizontal Bar 36 can be used to block Front Corner Leg Slot 12. This use of Top Horizontal Bar 36 would be in conjunction with Side Rail Slat 26. This allows greater range of motion to the dropside.

The materials used in the dropside assembly can be wood, metal, plastic, composite, or other materials commonly used in cribs. These materials allow differing strengths and weaknesses which would be used to match consumer preferences, needs, and budget restraints.

The embodiments above-discussed are to be considered illustrative and not restrictive. Thus, the scope of the invention should be determined by the appended claims and their legal equivalents.

CONCLUSIONS, RAMIFICATIONS, AND SCOPE

The utility of crib with hidden hardware is apparent. The use of hidden hardware mounted in the corner legs together with the use of the side rails mounted to the side rail slats reduces the chance of injury that a user or an occupant of a crib may sustain. That is, the user or occupant of the crib cannot readily access the hardware which allows the dropside of the crib to move vertically. In limiting this access, chance of injury is greatly reduced.

Another benefit of the invention is its sturdiness. Perhaps not readily apparent in the description presented above, in application, the crib with hidden hardware can support a large amount of weight without dropside failure.

Still another advantage of the crib with hidden hardware is its structural integrity. Such a crib does not easily come apart. Indeed, it would take considerable effort and force to cause separation of the assembled preferred embodiment of the crib with hidden hardware.

The above-discussion is to be considered illustrative and not restrictive. Thus, the scope of the invention should be determined by the appended claims and their legal equivalents.

We claim:

1. Crib hardware for a releasable crib side comprising:

a) a first side rail means which is channeled to receive a vertically aligned first slide rod and which is attached to a first side rail slat, b) a second side rail means which is channeled to receive a vertically aligned second slide rod and which is attached to a second side rail slat, c) a dropside means for supporting and connecting the first and second side rail slats and for supporting a latching means, d) a first corner leg means which is slotted to receive said first side rail means, channeled to receive the vertically aligned first slide rod, and channeled with a first recess to receive a latching means, e) a second corner leg means which is slotted to receive said second side rail means, channeled to receive the vertically aligned second slide rod, and channeled with a second recess to receive a latching means, f) a latching means for holding said dropside means in a locked upright position and for releasing said dropside means, whereby activating said latching means allows for the release of the first side rail means within the first corner leg means and along the first vertically aligned slide rod substantially contemporaneously with the release of the second side rail means within the second corner leg means and along the second vertically aligned slide rod such that the dropside means lowers until the first side rail means and second side rail means rest on the bottom of the slots of the first corner leg means and second corner leg means, respectively, such that access to the slots is blocked by the side rail slats.

2. The crib hardware as defined in claim 1, whereby access to the slots is additionally blocked by the dropside means.

3. The crib hardware as defined in claim 1, wherein the dropside means comprises a top horizontal bar, a bottom horizontal bar, and a plurality of slats vertically aligned and attached to the top horizontal bar and the bottom horizontal bar at spaced intervals.

4. The crib hardware as defined in claim 1, wherein the dropside means comprises a top horizontal bar, a bottom horizontal bar, and a plurality of slats vertically aligned and attached to the top horizontal bar and the bottom horizontal bar at spaced intervals, whereby access to the slots is additionally blocked by the dropside means.

5. The crib hardware as defined in claim 1, wherein the latching means comprises a first latch rod, a second latch rod, and a footplate connected to the first and second latch rods.

6. The crib hardware as defined in claim 1, wherein the latching means comprises a first latch rod, a second latch rod, and a footplate connected to the first and second latch rods, whereby access to the slots is additionally blocked by the dropside means.

7. The crib hardware as defined in claim 1, wherein the dropside means comprises a top horizontal bar, a bottom horizontal bar, and a plurality of slats vertically aligned and attached to the top horizontal bar and the bottom horizontal bar at spaced intervals, and wherein the latching means comprises a first latch rod, a second latch rod, and a footplate connected to the first and second latch rods.

8. The crib hardware as defined in claim 1, wherein the dropside means comprises a top horizontal bar, a bottom horizontal bar, and a plurality of slats vertically aligned and attached to the top horizontal bar and the bottom horizontal bar at spaced intervals, and wherein the latching means comprises a first latch rod, a second latch rod, and a footplate connected to the first and second latch rods, whereby access to the slots is additionally blocked by the dropside means.

9. A device for lifting and lowering a movable side of a baby's crib, said device comprising:

a) a movable dropside means comprising a top horizontal bar, a bottom horizontal bar, a plurality of slats vertically aligned and attached to the top horizontal bar and the bottom horizontal bar at spaced intervals, and a first and second side rail, b) a latching means comprising a first latch rod, a second latch rod, and a footplate connected to the first and second latch rods, with said latching means attached to said dropside means, c) a corner leg means comprising a first vertical slide rod, a second vertical slide rod, a first corner leg, and a second corner leg, wherein each corner leg is slotted to receive the dropside means, channeled to receive a vertical slide rod, and channeled with a recess to receive the latching means, whereby activating the latching means by actuating the footplate moves the latch rods away from the recesses in the corner leg means allowing the movable dropside means to move vertically within the corner leg means along the vertical slide rods, such that access to the slots in the corner leg means is blocked by the movable dropside means throughout the range of motion of the movable dropside means.

10. A method for lifting and lowering a movable side of a baby's crib, comprising the steps of:

a) providing a movable dropside means comprising a top horizontal bar, a bottom horizontal bar, a plurality of slats vertically aligned and attached to the top horizontal bar and the bottom horizontal bar at spaced intervals, and a first and second side rail, which are channeled to receive a vertical slide rod, b) attaching a latching means, comprising a first latch rod, a second latch rod, and a footplate connected to the first and second latch rods, to said movable dropside means, c) providing a corner leg means comprising a first vertical slide rod, a second vertical slide rod, a first corner leg, and a second corner leg, wherein each corner leg is slotted to receive the movable dropside means, channeled to receive a vertical slide rod, and channeled with a recess to receive the latching means, and d) activating the latching means by actuating the footplate to move the latch rods away from the recesses in the corner leg means, whereby the movable dropside means moves vertically within the corner leg means along the vertical slide rods, such that access to the slots in the corner leg means is blocked by the movable dropside means throughout the range of motion of the movable dropside means.

* * * * *